United States Patent [19]

Nunemaker

[11] 3,985,492

[45] Oct. 12, 1976

[54] COMBINATION CANDLE LIGHTER AND EXTINGUISHER

[76] Inventor: John J. Nunemaker, 2422 Davis Ave., Alexandria, Va. 22302

[22] Filed: Dec. 5, 1974

[21] Appl. No.: 529,844

[52] U.S. Cl. ..... 431/144; 431/269

[51] Int. Cl.[2] ..... F23Q 25/00

[58] Field of Search ..... 431/144, 287, 156, 146, 431/267, 269

[56] References Cited

UNITED STATES PATENTS

| | | | |
|---|---|---|---|
| 155,793 | 10/1874 | Davis | 431/269 |
| 968,330 | 8/1910 | De Rose | 431/269 |
| 1,740,623 | 12/1929 | Payne | 431/144 |
| 2,510,854 | 6/1950 | Bell | 431/269 |

FOREIGN PATENTS OR APPLICATIONS

| | | | |
|---|---|---|---|
| 309,328 | 1955 | Switzerland | 431/144 |
| 4,737 | 1914 | United Kingdom | 431/269 |

*Primary Examiner*—Carroll B. Dority, Jr.
*Attorney, Agent, or Firm*—Mason, Mason & Albright

[57] ABSTRACT

A substantially straight rod has on one end a candle flame extinguisher and on the other end an extension for holding a friction-type safety match. The body of the extinguisher may be a cone, a cylinder, or a box-shaped member which has the same longitudinal axis as the rod and with its single opening facing away from the rod with the edges of the extinguisher body surrounding its opening being so contoured that the device is stable upright on a flat horizontal surface. The extension may be in the form of a coil, bent-over part of the rod or as a separate member having an opening of appropriate size and configuration for snugly holding the part of the match away from its head whereby the match head extends outwardly from the device and substantially coincident with its longitudinal axis. The opening for the match may also be employed for hanging the device when not in use. In addition, the extension is adapted to be gripped by the user's fingers for holding the device when extinguishing the flame of a candle.

17 Claims, 7 Drawing Figures

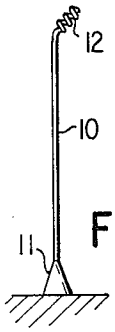
FIG.4
FIG.5
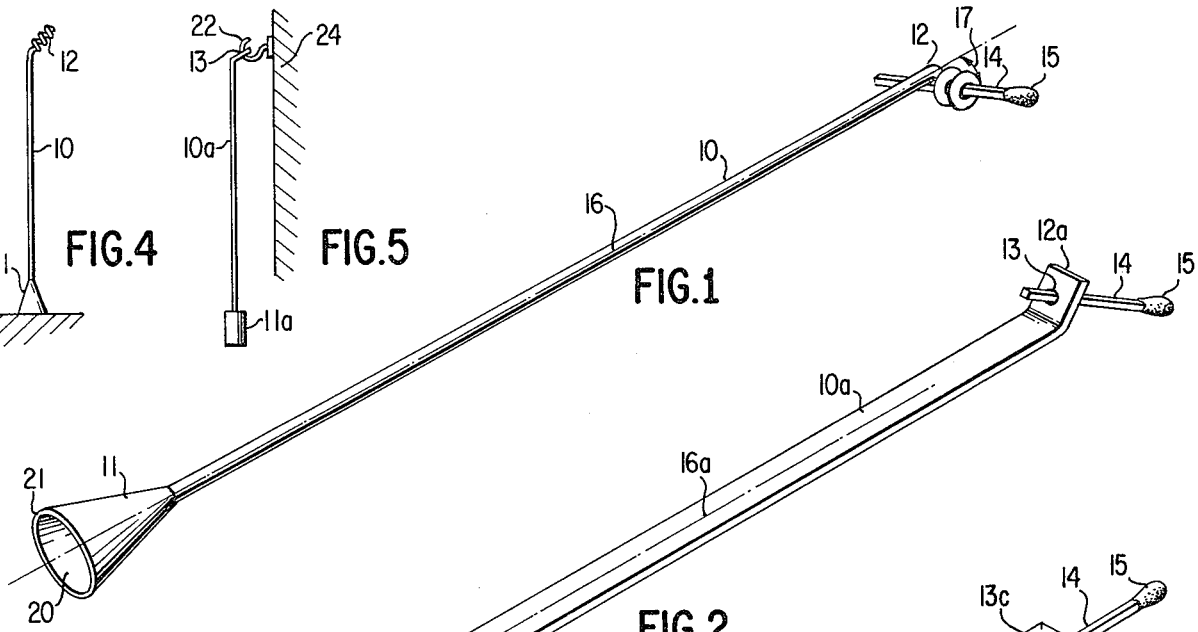
FIG.1
FIG.2
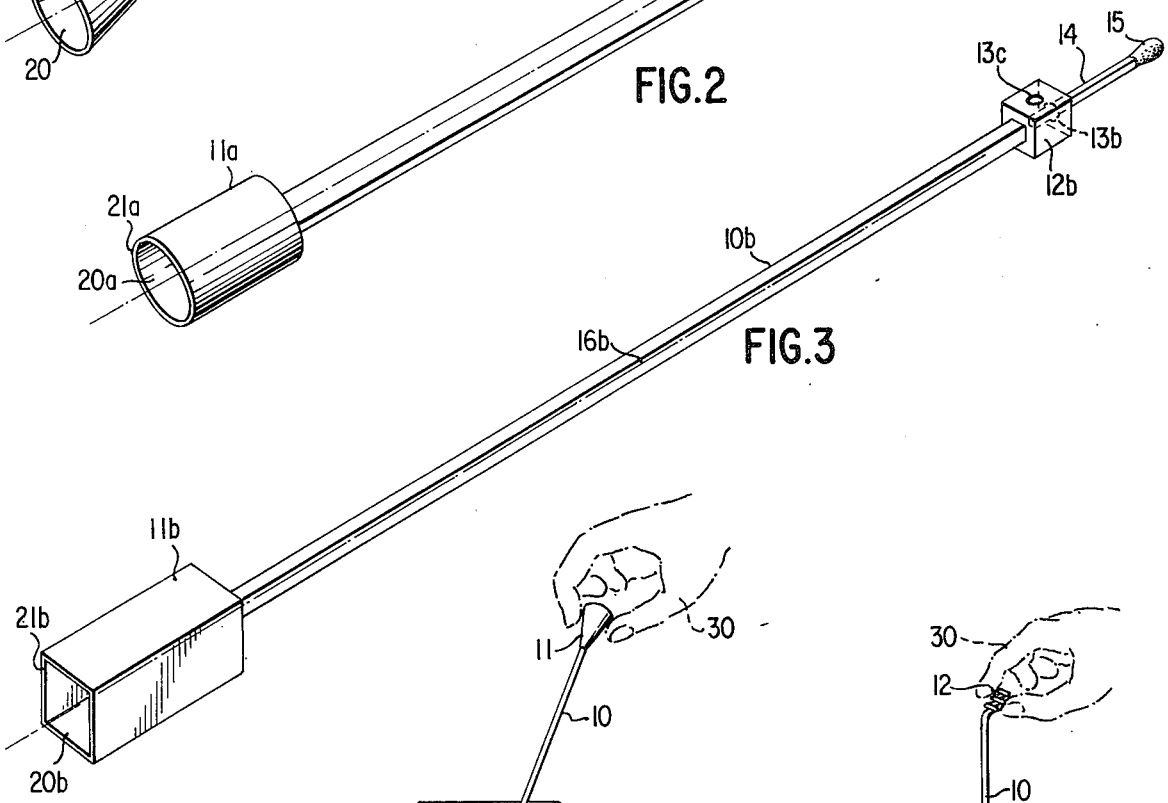
FIG.3
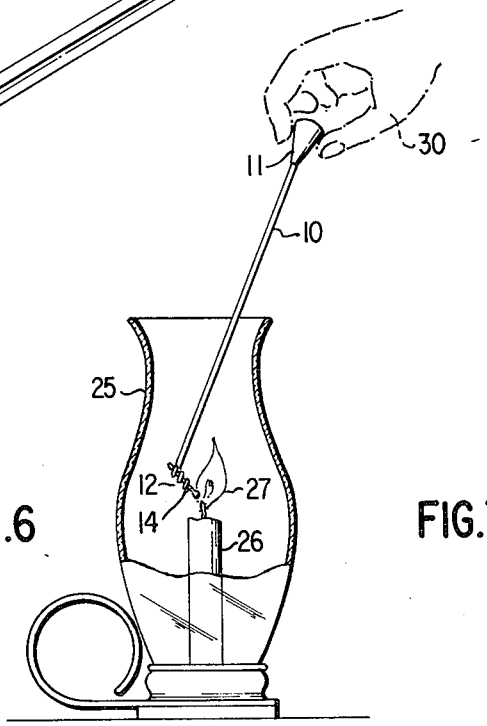
FIG.6
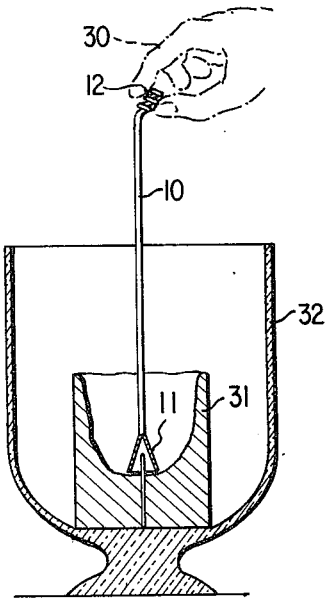
FIG.7

COMBINATION CANDLE LIGHTER AND EXTINGUISHER

BACKGROUND OF THE EXTENSION

Candle lighters and extinguishers in contemporary use are often limited in lighting and extinguishing the flame in present candle arrangements. For example, it is difficult to light by hand with an ordinary friction-type safety match without burning one's fingers relatively large candles such as those which are 4 or more inches in diameter and 10 or so inches high after they have burned several inches. An obvious solution to the problem is to use long matches. However these are somewhat expensive and frequently difficult to locate when the need arises. Further, when candles are placed in hurricane lamps, globes, vases or other containers, the same basic problem exists. Known commercially available lighters which use combustible gas or wick material are, because of their shape and bulk, unhandy and impracticable for igniting the flame in the above-mentioned candle arrangements. Other methods exist such as holding safety matches by tweezers and the like. However these means tend to be overly clumsy and frequently difficult to manipulate.

The same general comments set forth above apply to the extinguishing of the flame of the candle inasmuch as present day extinguishers are often mounted on a shaft in a relationship of approximately a 90° angle or more which does not permit the extinguisher to be lowered into various containers for the candle. The candle can, of course, simply be blown out but this causes some danger that hot wax may be displaced and land on the individual who is extinguishing the candle or someone else nearby or on linen or furniture. Also simply covering the top of the container is effective provided a nonflamable material is used for this purpose which may not always be handy.

In view of the foregoing problems, a present need exists with the increasing use of candles for lighting arrangements for special occasions in the home and otherwise, and indeed a need has long existed, for a device which is particularly suitable for both lighting and extinguishing candles which are in vases or otherwise difficult to reach and which at the same time may be easily stored so that it is conveniently available when a requirement for its function arises.

SUMMARY OF THE INVENTION

The invention relates to a combination of candle lighter and candle flame extinguisher and more particularly to such a combination to be utilized on candles where the flame is surrounded on all sides except the top by a vase, container or the sides of the candle itself.

The primary purpose of the candle lighter-extinguisher combination of the instant invention is to light the wick of a candle and to extinguish the flame as desired. The device comprises a shaft with an extension for holding a safety match or the like on one end and an extinguisher on the opposite end. It finds use not only in homes but also churches, restaurants, cocktail lounges and the like. When the device is being used to light the wick of a candle, the portion which functions to extinguish the flame is utilized as a handle for gripping for the device. Subsequently, when extinguishing the flame, then the extension for holding the match is utilized for holding the device during this operation. The shaft of the device can be of any desired length; however 20 to 32 centimeters is considered practicable for most household uses.

The lighter end of the shaft or rod is an extension which is adapted for holding a friction-type safety match. This is accomplished by twisting such extension into a coil with an opening of about two to three millimeters width through its center whereby the end of a safety match can be inserted therein and snugly held by giving the match a twisting action when it is being placed in the opening. In another embodiment, the extension is simply a bent-over end of the shaft or rod with an opening provided through it adapted for receiving and again snugly holding a match. Alternatively, a further member may be utilized for this purpose. However, whatever is used for holding the match should also be, as indicated above, suitable for gripping the device when subsequently extinguishing the flame.

The extinguisher end of the shaft or rod can be either a cone-shaped member, a cylinder or cube or other suitable shape which is hollow and has its opening facing away from the connection to the rod. The flame is thus extinguished simply by placing the opening over the flame and cutting off its oxygen. The extinguishing portion has two further functions. One is that the bottom or the portion which surrounds the opening be appropriately contoured so that the device is stable upright on a flat horizontal surface. The other purpose is that the extinguisher has such a shape that it can be utilized as means for holding the device when the match is in the extension at the other end. In this connection, the opening for the match may be also utilized for hanging the device when not in use in a manner of many kitchen utensils. A further opening can be provided for this purpose, however, if desired.

An important aspect of the invention is that the shaft or rod is substantially straight with the body of the flame extinguisher being on the substantially same longitudinal axis as the rod and, additionally, that the extension and holder for the match is so adapted whereby the match also extends out in the other direction substantially along the longitudinal axis of the device.

The objects of the instant invention are directed towards a device with the structural and functional advantages as set forth above. However, other objects, adapabilities and capabilities of the invention will be appreciated as the description progresses, reference being had to the accompanying drawings in which:

BRIEF DESCRIPTION OF THE DRAWINGS

FIG. 1 is a perspective view showing a first embodiment of the invention;

FIG. 2 is a view similar to FIG. 1 showing a second embodiment of the invention;

FIG. 3 is a view similar to FIGS. 1 and 2 showing a third embodiment of the invention;

FIG. 4 shows the embodiment of FIG. 1 standing in an upright position;

FIG. 5 shows the second embodiment of FIG. 2 in a side view wherein the device is hanging from the hook;

FIG. 6 illustrates use of the device for lighting a candle in a hurricane lamp; and FIG. 7 illustrates use of the invention in extinguishing the flame of a large candle contained in a vase.

DESCRIPTION OF THE PREFERRED EMBODIMENTS

In FIG. 1, a shaft or rod 10 which is circular in cross-section has affixed at one end a conical-shaped extinguisher 11 and at the opposite end a coil-shaped extension 12 with an opening of roughly 2 to 3 millimeters in diameter which receives a friction type safety match 14 with the match head 15 disposed outwardly of the device. It will be noted that the longitudinally axis 16 of the device is also the longitudinal axis of the body of the extinguisher 11 and that the match 14 extends substantially in the direction of axis 16 away from rod 10 — actually at an acute angle 17 with axis 16 which is preferably in a range of 5 to 45° so the match is not held perfectly vertical when ignited.

It will be noted that extinguisher 11 is hollow, has a single opening 20 and that the edges 21 which surround opening 20 are contoured so that as shown in FIG. 4 the device is capable of standing upright without assistance on a flat horizontal surface.

In the embodiment shown in FIG. 2 the shaft or rod 10*a* has an elongated rectangular cross-section and the body of extinguisher 11*a* is cylindrical in shape. The extension 12*a* comprises a bent-over portion of the shaft 10*a* and is provided with an opening 13 which is approximately two to three millimeters in diameter for receiving match 14 so that match head 15 is about coincident with the longitudinal axis 16*a* of the device. Extinguisher 11*a* has a single opening 20*a* opposite its connection to rod 10*a* and axis 16*a* is also the longitudinal axis of extinguisher 11*a*. Again, the edges 21*a* which surroung opening 20*a* are contoured so that the device is capable of standing upright on a flat horizontal surface without assistance.

In FIG. 5 it will be noted that the embodiment shown in FIG. 2 has its opening 13 received by a hook 22 which is applied to a wall 24. Bent-over portion 12*a* is advantageous for this purpose inasmuch as the device can be applied to hook 22 with more facility than would be the situation otherwise.

In the embodiment shown in FIG. 3, it will be noted that rod 10*b* has a square cross-section and that the body of the extinguisher 11*b* is a parallel piped shaped or more specifically, box-shaped with a square opening 20*b*. In this embodiment, extension 12*b* consists of a separate member which is affixed to the end of rod 10*b* and has an opening 13*b* approximately two to three millimeters in diameter for receiving the friction-type safety match 14 with head 15. Match 14 as such, rod 10*b* and extinguisher 11*b* all have their longitudinal axes conincident with the longitudinal axis 15*b* of the device. Optionally, a further opening 13*c* may be placed in the extension 12*b* for hanging the device. As with the embodiments in FIGS. 1 and 2, the edges 21*b* surrounding opening 20*b* are contoured so that the device shown in FIG. 3 is capable of standing upright unassisted on a flat horizontal surface.

As previously mentioned, shafts 10, 10*a* and 10*b* can be of any desired length which preferably for most uses is about 20 to 32 centimeters. The width of the openings 20, 20*a* and 20*b* is each roughly two centimeters and each body of the extinguisher 11, 11*a* and 11*b* is roughly 2½ centimeters in length. It will be appreciated that these dimensions are not critical except to the extent that different dimensions and configurations might prevent the practice of the invention with the structural and functional advantages heretofore discussed. Also it will be noted that the device is of such a size and shape that it can easily be stored with candles.

In FIG. 6, it will be noted that the body of extinguisher 11 is being gripped by the fingers of a hand 30 to hold the device within a hurricane lamp 25 for the purpose of supporting match 14 by means of the extension 12, thereby lighting candle 26 to produce the flame 27. In FIG. 7 the fingers of hand 30 are shown gripping coil extension 12 whereby shaft 10 is inserted into the opening of a vase 32 to extinguish the flame of a large candle 31 by means of extinguisher 11.

It is to be understood that the device may be composed of any desired appropriate metal or combinations of metals such as silver, silver plate, bronze, brass, copper, aluminum, wrought iron, galvanized steel, stainless steel, and the like. It also may be composed of a plastic or wood material provided that extinguisher 11 and extension 12 are appropriately fireproofed or rendered sufficiently fire-resistant. Extinguisher 11, 11*a* and 11*b* may be brazed, soldered or welded to their respective shaft or rod 10, 10*a* or 10*b* or may be integral therewith. In any event, it is to be understood that although I have described preferred embodiments of the invention, numerous other adaptations, and modifications may be made without departing from the spirit of the invention as defined within the scope of the appended claims.

Having thus described my invention, what I claim as new and desire to secure by Letters Patent of the United States is:

1. A combination candle lighter and extinguisher which comprises a substantially straight rod, candle extinguishing means affixed to one end of said rod, and match-holding means affixed to the other end of said rod, said candle extinguishing means comprising a receptacle-shaped body which is hollow and has an annular base defining a single opening in said base for receiving the candle's flame, said single opening being opposite the connection of said rod to said body, said body having substantially the same longitudinal axis as said rod, said annular base having sufficient cross-section and area to support said body and the remainder of the combination in an upright vertical position on a horizontal flat surface, the end of said rod opposite said body defining a further opening adapted to engage frictionally and hold a match opposite the head of the match, said match-holding means performing the function of supporting a match outwardly of said rod at an angle of not more than about 45° relative to the longitudinal axis of said rod.

2. A combination in accordance with claim 1, wherein said body is substantially conical in shape with said rod being connecting at the apex of said conically-shaped body and said opening being located at the base thereof.

3. A combination in accordance with claim 2, wherein said match holding means is formed by an extension of said rod from said other end opposite said body.

4. A combination in accordance with claim 3, wherein said extension is in the form of a coil which defines an opening therein of about two to three millimeters in width adapted to receive a match.

5. A combination in accordance with claim 1, wherein said match holding means is formed by an extension of said rod provided from said end thereof opposite said body.

6. A combination in accordance with claim 5, wherein said extension is in the form of a coil which defines an opening of about two to three millimeters in width to receive a match.

7. A combination in accordance with claim 5, wherein said extension comprises a bent-over portion of said rod, an opening in said portion being provided which is adapted to receive a match at the end thereof away from the match head.

8. A combination in accordance with claim 7, wherein said rod has a cross-section of an elongated rectangle.

9. A combination in accordance with claim 1, wherein said match holding means comprises a separatable member provided with an opening for snugly receiving a match away from the head thereof.

10. A combination in accordance with claim 9, wherein said separable member is substantially in the shape of a cube, said member's opening being adapted to hold a match substantially in the longitudinal axis of said rod.

11. A combination in accordance with claim 1, wherein said body is substantially cylindrically-shaped, said rod being connected to said body coincident with the longitudinal axis of said cylindrically-shaped body.

12. A combination in accordance with claim 1, wherein said body is substantially box-shaped, said rod being connected to said body at substantially at its central part opposite said opening.

13. A combination in accordance with claim 12, wherein said rod is substantially square in cross-section.

14. A combination in accordance with claim 1, wherein the over-all length of said rod is about twenty to thirty-two centimeters.

15. A combination in accordance with claim 1, wherein the width of said body is about two centimeters.

16. A combination in accordance wth claim 1, wherein said match holding means comprises a handle portion extending from the end of said rod which is adapted to provide holding means for holding the combination when being used to extinguish the flame of a candle.

17. A combination in accordance with claim 1, wherein said match holding means comprises means for hanging the combination for storage from a projection provided therefor when the combination is not in use.

* * * * *